US007000288B2

(12) United States Patent
Nighy

(10) Patent No.: US 7,000,288 B2
(45) Date of Patent: Feb. 21, 2006

(54) HOSE AND WAND ASSEMBLY

(75) Inventor: Richard John Nighy, Camden (GB)

(73) Assignee: Dyson Limited, Wiltshire (GB)

( * ) Notice: Subject to any disclaimer, the term of this patent is extended or adjusted under 35 U.S.C. 154(b) by 285 days.

(21) Appl. No.: 10/169,904

(22) PCT Filed: Jan. 8, 2001

(86) PCT No.: PCT/GB01/00051

§ 371 (c)(1),
(2), (4) Date: Jul. 11, 2002

(87) PCT Pub. No.: WO01/50940

PCT Pub. Date: Jul. 19, 2001

(65) Prior Publication Data

US 2002/0189046 A1 Dec. 19, 2002

(30) Foreign Application Priority Data

Jan. 13, 2000 (GB) ..... 0000597

(51) Int. Cl.
*A47L 9/32* (2006.01)

(52) U.S. Cl. ..... 15/327.1; 15/334; 15/410; 285/7

(58) Field of Classification Search ..... 15/327.1, 15/331, 334, 335, 410, 414; 285/7
See application file for complete search history.

(56) References Cited

U.S. PATENT DOCUMENTS

| | | | | |
|---|---|---|---|---|
| 4,345,805 A | | 8/1982 | Finley et al. | 285/7 |
| 4,625,998 A | | 12/1986 | Draudt et al. | 285/7 |
| 5,031,266 A | | 7/1991 | Tillman et al. | 15/327.2 |
| 5,747,764 A | * | 5/1998 | Son et al. | 15/410 |
| 5,815,883 A | | 10/1998 | Stein et al. | 15/327.1 |

FOREIGN PATENT DOCUMENTS

| | | |
|---|---|---|
| EP | 0 621 003 A2 | 10/1994 |
| EP | 0 733 336 A2 | 9/1996 |
| EP | 0 882 422 A1 | 12/1998 |
| GB | 7914 | 1/1914 |
| GB | 2 308 543 A | 7/1997 |
| JP | 05-164580 | 6/1993 |
| JP | 11-313788 | 11/1999 |

* cited by examiner

*Primary Examiner*—Theresa T. Snider
(74) *Attorney, Agent, or Firm*—Morrison & Foerster LLP

(57) ABSTRACT

A hose and wand assembly for a domestic appliance includes a flexible hose portion, a rigid wand portion and a handgrip portion. The hose terminates in a curved end portion which couples to the wand in such a manner that the hose is able to swivel about the longitudinal axis of the wand. The end portion has an outlet which communicates with the interior of the wand. A support is located on the outer wall of the end portion upstream of the outlet. The support is capable of pivotal movement about the longitudinal axis of the rigid wand portion. The hose is also rotatable with respect to the wand about the longitudinal axis of the hose.

15 Claims, 5 Drawing Sheets

HOSE AND WAND ASSEMBLY

FIELD OF THE INVENTION

The invention relates to a hose and wand assembly for a domestic appliance, particularly but not exclusively for a vacuum cleaner.

BACKGROUND OF THE INVENTION

Cylinder vacuum cleaners generally comprise a main body containing separating apparatus for separating dirt and dust from an airflow. The airflow is introduced to the main body via a hose and wand assembly to the distal end of which is normally attached a cleaning tool. The hose and wand assembly comprises a rigid wand portion which is attached to the main body via a flexible hose. The flexible hose is commonly connected to the wand portion by way of a rotatable coupling which allows the flexible hose to rotate about its own axis whilst remaining coupled to the rigid wand portion. A handgrip portion is commonly located at the end of the rigid wand portion remote from the cleaning tool and adjacent the flexible hose. By means of the gripping portion, the cleaning tool is manoeuvered over the surface to be cleaned so as to introduce dirt-laden air to the main body. The dirt can then be separated from the airflow and retained in the main body whilst the cleaned air is returned to the environment.

Upright vacuum cleaners normally include a main body containing dirt and dust separating apparatus to which dirt-laden air is introduced via a ground-engaging cleaning head mounted on the body. However, many upright vacuum cleaners are convertible into cylinder cleaners by way of a hose and wand assembly which can optionally be brought into operation in place of the ground-engaging cleaning head. The hose and wand assembly normally used in connection with an upright vacuum cleaner has the same general construction as that described above in relation to cylinder cleaners. Other domestic appliances such as carpet shampooing machines can include hose and wand assemblies of the same type.

A difficulty associated with conventional hose and wand assemblies is that they can be cumbersome and difficult to manoeuvre, particularly when accessing restricted areas and when the hose becomes distorted due to an excessive amount of twisting. Also, in order to allow a sufficient length of flexible hose for most purposes, and in order to ensure that the incoming air is not restricted whilst passing along the hose, a flexible hose of substantial length and diameter has to be provided. In order to provide sufficient durability, the flexible hose therefore has to be made of a durable material and this can result in the hose being relatively heavy which inevitably causes some restrictions to the manoeuverability of the hose and wand assembly and/or the floor tool carried thereby. Hoses along which electrical conductors must be provided can be heavier still, and are sometimes less flexible. A further difficulty with conventional hose and wand assemblies is that, in order to achieve good pick-up results, the cleaning tool must be pressed firmly to the floor or carpet. This means that the hose, which can be bulky and/or heavy, must be lifted further off the ground which is inconvenient for the user and adds to the load and stresses acting on the user's hand and wrist. The loads and stresses acting on the user's hand can also be increased if the user chooses to move the body of the cleaner across the floor by pulling either the hose or the handle of the wand in the desired direction.

U.S. Pat. No. 5,815,883 describes a hose and wand assembly for a vacuum cleaner in which a rigid elbow is interposed between a suction pipe (wand) and a hose, the elbow having a rotating knuckle joint which allows the hose to rotate with respect to the pipe.

SUMMARY OF THE INVENTION

It is an object of the present invention to provide a hose and wand assembly for a domestic appliance in which the manoeuverability is improved. It is a further object of the invention to provide a hose and wand assembly for a domestic appliance which, in use, reduces the loads and stresses applied to the user's hand.

The invention provides a hose and wand assembly for a domestic appliance comprising a flexible hose portion connectable to a body of the appliance, a rigid wand portion attachable to or including a tool for use with the appliance, and a handgrip portion attached to the rigid wand portion, the rigid wand portion being manoeuvrable, in use, by means of the handgrip portion, the flexible hose portion terminating in a curved end portion which couples to the rigid wand portion in such a manner that the flexible hose portion is able to swivel about the longitudinal axis of the rigid wand portion, the end portion having an outlet which communicates with the interior of the wand, and wherein the end portion has a support on the outer wall thereof, the support being located upstream of the outlet and capable of pivotal movement about the longitudinal axis of the rigid wand portion.

By coupling the rigid wand portion to the flexible hose portion in a manner which allows swivelling about the longitudinal axis of the rigid wand portion, many of the stresses developed within the flexible hose portion during normal use of the hose and which are transmitted to the rigid wand assembly are eliminated. The flexible hose portion is able to swivel with respect to the rigid wand portion in response to any torsional stresses developed so that the stresses which would otherwise be transmitted to the wand are reduced or eliminated. In this way, the user of the domestic appliance is not required to apply physical forces to overcome the torsional stresses which might otherwise be developed. The position of the tool is thereby easier to control and the manoeuverability of the tool over the surface to be cleaned is improved.

By supporting the end portion of the hose at a position upstream of the outlet, the hose is rotatably coupled to the wand. This significantly reduces the proportion of the weight of the hose which is borne by the connection between the outlet of the hose and the wand. This allows the hose to rotate more freely with respect to the wand and also reduces the likelihood of the seal at the outlet from becoming damaged.

It will be appreciated that the curved end portion of the hose could be a smoothly curved arc, an angled part or any other non-straight conduit that causes the hose to extend away from the wand in a different direction to the longitudinal axis of the wand.

These improvements to the conventional hose and wand assembly have particular application to domestic appliances, specifically vacuum cleaners. They have particular benefits for elderly and disabled users. However, by eliminating unwanted stresses which might otherwise be applied to a user's hand and wrist, the improvements can also be beneficial to all users.

BRIEF DESCRIPTION OF THE DRAWINGS

An embodiment of the present invention will now be described with reference to the accompanying drawings, in which.

DETAILED DESCRIPTION OF THE INVENTION

Figure 1:
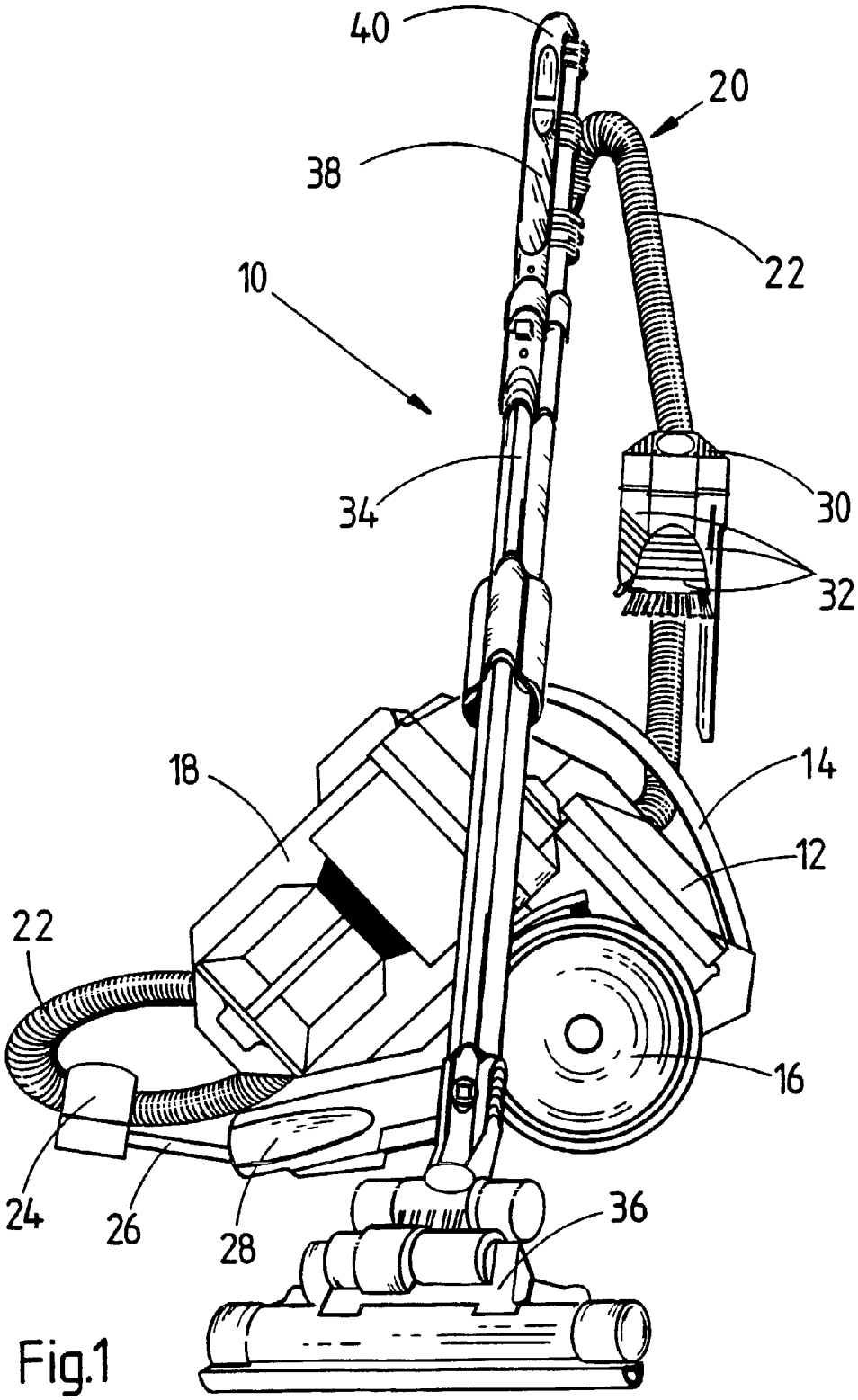
FIG. 1 is a view of a cylinder vacuum cleaner incorporating a hose and wand assembly according to the present invention.

The vacuum cleaner 10 illustrated in FIG. 1 comprises a main body 12 having a handle 14, supporting wheels 16 and separating apparatus 18. The separating apparatus 18 illustrated in this embodiment takes the form of a cyclonic separating device of a type known to be used in domestic vacuum cleaners. A full description of this type of separating apparatus can be found in EP 0 042 723B but this arrangement does not form part of the present invention. Indeed, the separating apparatus 18 illustrated in FIG. 1 could quite adequately be replaced by the more conventional bag-type separator or other separation apparatus if desired. The main body 12 also houses other essential components of a vacuum cleaner; namely, an electrically operated motor, a fan driven by the motor and arranged to develop suction within the separating apparatus 18, filters designed and located so as to protect the fan and motor, an electric cable for connection to a mains supply and an on/off control switch. All of these components, none of which are specifically illustrated in FIG. 1, are well known and commonly present in domestic vacuum cleaners.

The vacuum cleaner 10 also includes a hose and wand assembly 20. The hose and wand assembly 20 comprises a flexible hose portion 22 which is connected at its proximal end and in a known manner to the main body 12 via a connecting socket (not shown). The connecting socket leads directly to a dirty air inlet of the separating apparatus 18. The hose portion 22 is constrained and held in a fixed position by a collar 24 located on an arm 26 which projects forwardly from a lower portion 28 of the main body 12, in a currently known manner.

The hose portion 22 is manufactured from a durable plastics material using any known, standard construction. The hose portion 22 also carries a tool holder 30 on which three accessory tools 32 are conveniently stored.

The hose and wand assembly 20 also comprises a rigid wand portion 34, the interior of which communicates with the distal end of the hose portion 22. The wand portion 34 consists of two telescopically-slidable portions so that the overall length of the wand portion 34 can be adjusted to suit the needs of the user of the vacuum cleaner 10. The end of the wand portion 34 remote from the hose portion 22 is adapted and arranged to receive a floor tool 36 in any known manner. For example, the floor tool 36 can be connected to the wand portion 34 by means of an interference fit, interconnecting bayonet fittings, snap-fit connections, a screw threaded collar and sleeve, or by any other suitable means. It is highly advantageous if the floor tool 36 is connectable to the wand portion 34 by means which will also allow the accessory tools 32 to be connected to the wand portion 34 as and when desired. It will be appreciated that the means by which the portions of the wand portion are telescopically moveable, and the means by which the floor tool 36 and/or the accessory tools 32 are connected to the wand portion 34, are immaterial to the present invention.

A handgrip portion 38 is attached to the end of the wand portion 34 adjacent its connection with the hose portion 22. The handgrip portion 38 includes a gripping portion 40 which is designed and located so as to be grasped by a user of the vacuum cleaner 10. When the gripping portion 40 is grasped by the user, the user is able to manoeuvre the floor tool 36 (or other accessory tool 32 attached to the distal end of the wand portion 34) across a surface to be cleaned so as to introduce dirt-laden air into the separating apparatus 18 via the wand portion 34 and the flexible hose portion 22.

Figure 2:
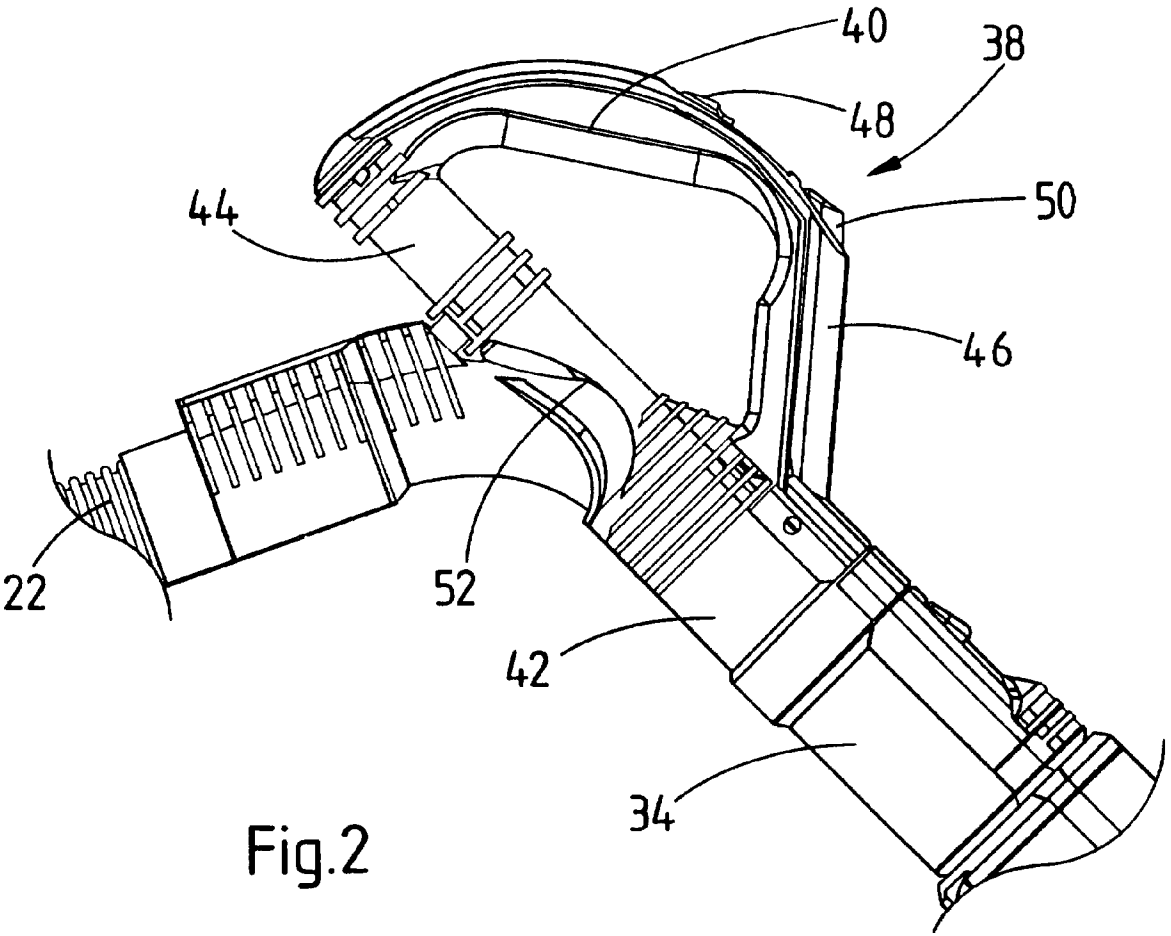
FIG. 2 is a side view of part of the hose and wand assembly illustrated in FIG. 1.
Figure 3:
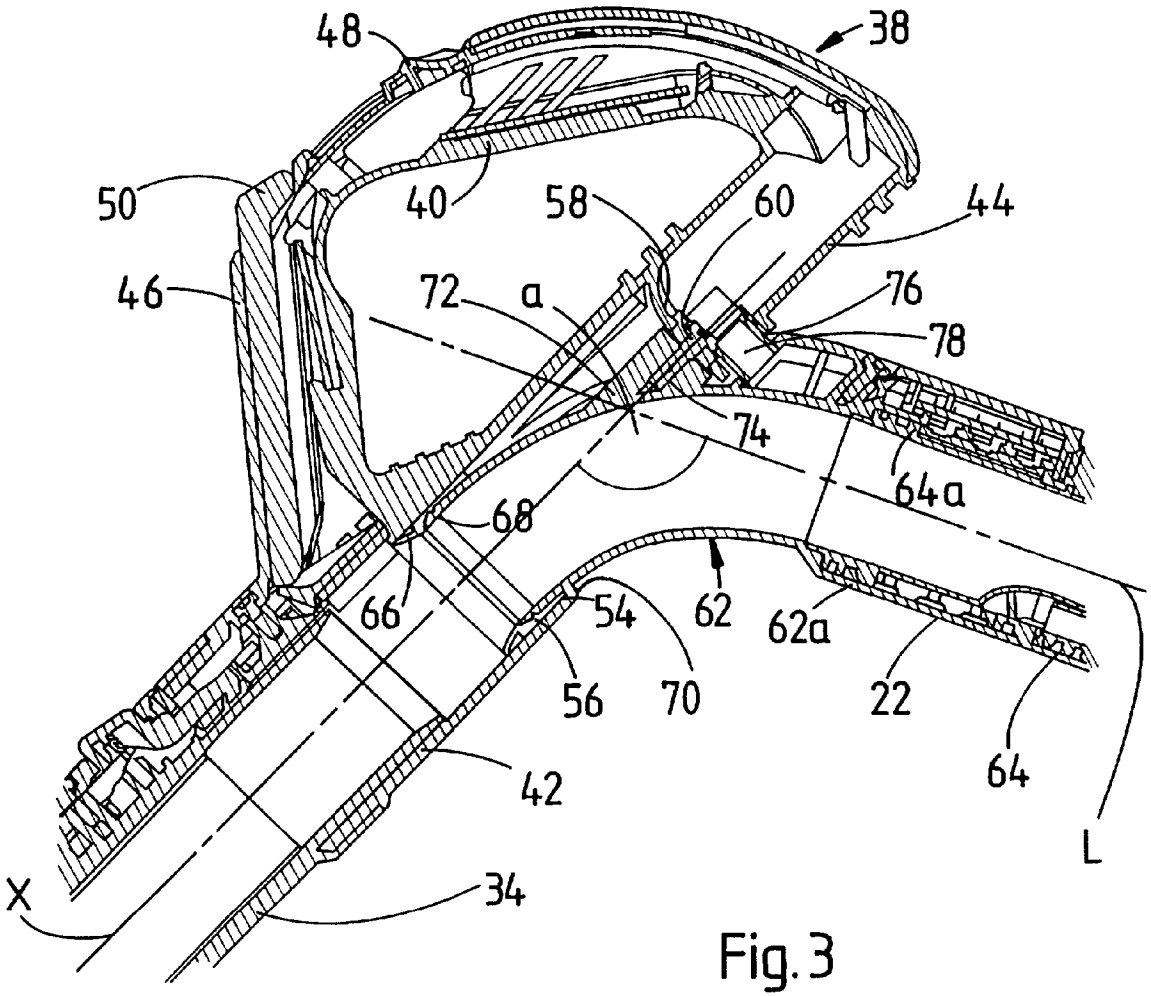
FIG. 3 is a sectional side view of the part shown in FIG. 2 taken from the other side.

FIGS. 2 and 3 show the connection between the hose portion 22 and the wand portion 34 in the vicinity of the handgrip portion 38. As can be seen, the end of the wand portion 34 to which the hose portion 22 is connected comprises a hollow tube portion 42. The hollow tube portion 42 extends on a first side thereof in a direction away from the wand portion 34 so as to form a support member 44 for the gripping portion 40. A first end of the gripping portion 40 is rigidly attached to the support member 44 and the gripping portion 40 is contoured and shaped so as to be comfortably grasped by a user of the vacuum cleaner 10. A second end of the gripping portion 40 is connected to a second support member 46 forming part of the handgrip portion 38. The second support member 46 is rigidly connected to the hollow tube portion 42. A control button 48 is provided on the gripping portion 40 so as to be immediately accessible to the user. Electrical connectors (not shown) connecting the control button 48 to the appropriate control devices within the vacuum cleaner 10 are housed within the second support member 46 and lead to appropriate contacts and connections within the vacuum cleaner. A button 50 for manually operating a bleed valve (not shown) is provided on the gripping portion 40. The bleed valve does not form part of the present invention.

An opening 52 is formed on the side of the support member 44 remote from the handgrip portion 38. The interior of the hollow tube portion 42 is shaped so as to form a circular socket 54 having an internal diameter similar to that of the rest of the wand portion 34. A resilient lip 56 is formed on the internal surface of the hollow tube portion 44 a short distance from the circular socket 54.

An internal wall 58 is located inside the support member 44 and extends across the interior thereof on the side of the opening 52 remote from the wand portion 34. A peg 60 extends through an aperture in the internal wall 58 from the side thereof remote from the wand portion 34 to the opposite side. The peg 60 protrudes into the cavity between the internal wall 58 and the circular socket 54.

The hose portion 22 comprises an end portion 62 to which the flexible hose 64 is attached. The flexible hose 64 is attached to the end portion 62 in such a manner that the flexible hose is able to rotate about the longitudinal axis L thereof at the point at which the connection is made. Essentially, the end 64*a* of the flexible hose 62 is received in a socket 62*a* of the end portion 62 in a snap-fit manner which also allows the end 64*a* to rotate freely within the socket 62*a*.

The end portion 62 comprises a conduit which is curved in side view. The distal end of the end portion 62, i.e. the end remote from the flexible hose 64, is dimensioned so as to fit with little or no play into the circular socket 54. A lip seal 66 is provided around the end of the end portion 62 which is received within the circular socket 54. This end of the end portion 62 also includes a circumferential groove 68 located and adapted to receive the resilient lip 56 when the end portion 62 is properly located within the circular socket 54. A projection 70 is also provided on the external surface of the end portion 62 in order to limit axial movement of the end portion 62 within the circular socket 54.

Located on the wall of the end portion 62, at a position which intersects with the longitudinal axis X of the wand portion 34, is a supporting lug 72. The supporting lug 72 is generally cylindrical in shape and extends in the direction of the longitudinal axis X. The supporting lug 72 has a blind bore 74 located therein, the blind bore 74 also extending coaxially with the longitudinal axis X. The blind bore 74 is dimensioned so as to receive the peg 60 in a freely rotatable manner. An aperture 76 is provided in the wall of the support member 44 adjacent the head of the peg 60. The aperture 76 is dimensioned so as to receive a channel 78 which is mounted on the end portion 62 of the hose portion 22. The channel 78 is dimensioned and adapted to carry electrical conductors (not shown) extending between the flexible hose 64 and the control button 48.

When the hose portion 22 is connected to the wand portion 34, the end portion 62 is inserted into the circular socket 54 as far as the projection 70 will allow. In this position, the resilient lip 56 engages with the circumferential groove 68 so as to prevent the end portion 62 from being withdrawn. The lip seal 66 engages with the interior surface of the hollow tube portion 42 in a manner which will allow relative rotation between the wand portion 34 and the end portion 62 about the longitudinal axis X.

At the same time as the end portion 62 is engaged within the circular socket 54, the blind bore 74 in the supporting lug 72 becomes axially aligned with the peg 60. The channel 78 passes through the aperture 76 into the interior of the support member 44 so as to provide a passageway for the electrical connectors. The co-operation of the peg 60 and the blind bore 74 means that the end portion 62 is held within the support member 44 whilst allowing relative rotation between the end portion 62 and the wand portion 34 about the longitudinal axis X. The peg 60 can be screw-threaded to ensure that the peg 60 cannot become disengaged from the blind bore 74.

As can be seen from FIGS. 2 and 3, the gripping portion 40 of the handgrip portion 38 is located on the side of the coupling between the hose portion 22 and the wand portion 34 which is remote from the wand portion 34. In other words, the gripping portion 40 is located so that, when the vacuum cleaner 10 is in use, the gripping portion 40 is behind the coupling and therefore closer to the user than the coupling. This is also beneficial to the user from the point of view of reducing the amount of stress applied to the user's hand and wrist during operation of the vacuum cleaner 10.

As can also be seen from FIG. 3, the angle a between the longitudinal axis L of the flexible hose portion 22 and the longitudinal axis X of the wand portion 34 is less than 120°. In the embodiment illustrated, the angle a is substantially 115°. This is quite considerably less than the angle between the same axes in prior art arrangements, this angle normally being as great as 135° or 140°. By reducing the angle a to substantially 115°, the portion of the hose and wand assembly 20 is better balanced than in known arrangements so that, when the floor tool 36 is pressed onto the floor or surface to be cleaned, the hose portion 22 does not need to be lifted as far as has previously been required. Again, stresses applied to the user's hand and wrist are reduced.

Figure 4A:
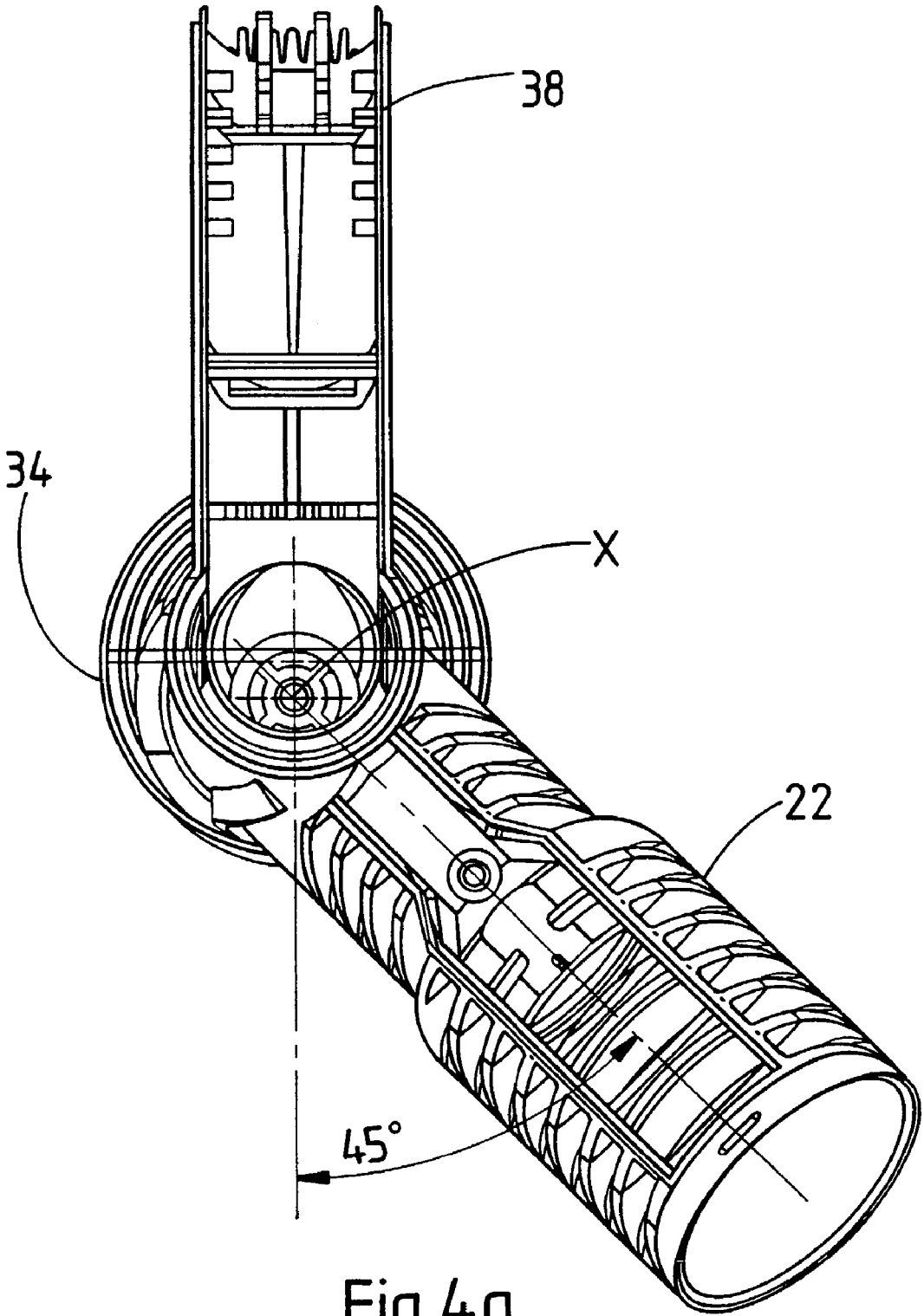
FIGS. 4*a* and 4*b* are first and second rear views respectively of the part shown in FIGS. 2 and 3, illustrating two different positions of the hose portion with respect to the pipe portion thereof.
Figure 4B:
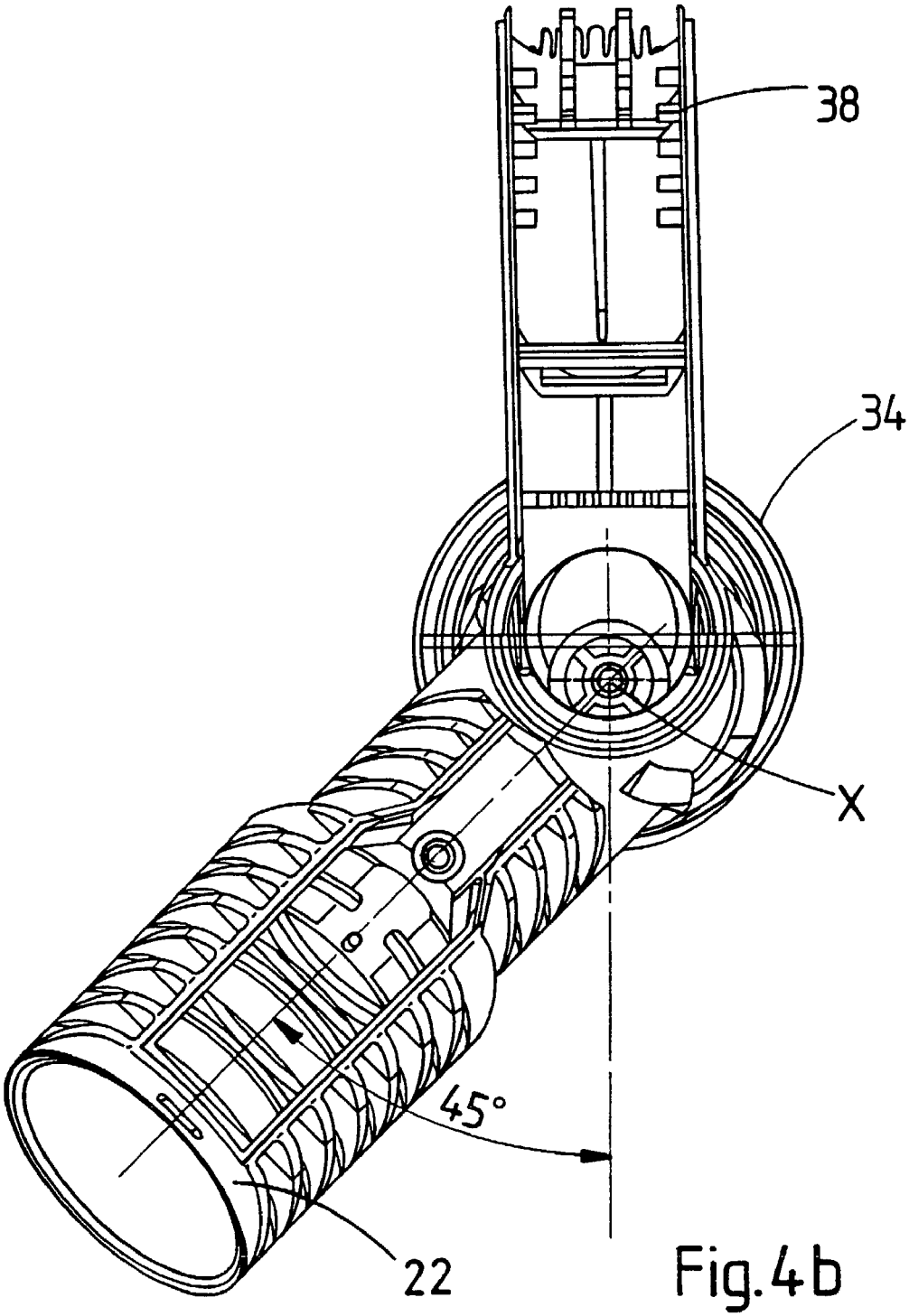

As can be seen from FIGS. 4*a* and 4*b*, the hose portion 22 can be swivellingly turned about the longitudinal axis X of the wand portion 34. The limits of angular rotation are at least 60° but are more preferably as great as 90°. This free rotation between the portions of the hose and wand assembly 20 means that torsional forces which might otherwise have been generated within the assembly during use thereof are either not so generated or are absorbed. Torsional forces which might have been developed within the hose are therefore not passed on to the wand portion 34 and, more particularly, to the handgrip portion 38. This means that the user of the vacuum cleaner 10 does not have to apply physical forces to the vacuum cleaner in order to counter the torsional forces which might otherwise have acted upon the users hand. The manoeuverability of the hose and wand assembly is thereby greatly improved which means that the vacuum cleaner as a whole is easier to use.

It will be appreciated that the invention is not intended to be limited to the precise details of the embodiment illustrated above. For example, the type of separating apparatus contained within the main body 12 can, as mentioned previously, be cyclonic or of the more conventional bag configuration. Neither is the design of the wand portion relevant to the present invention: the wand portion need not be made telescopic if this feature is not required. Other variations and alternative configurations, for example of the handgrip portion, will be apparent to a skilled reader.

What is claimed is:

1. A hose and wand assembly, comprising a flexible hose portion connectable to a body of an appliance, a rigid wand portion attachable to or including a tool for use with the appliance, and a handgrip portion attached to the rigid wand portion, the rigid wand portion being manoeuverable, in use, by means of the handgrip portion, the flexible hose portion terminating in a curved end portion which couples to the rigid wand portion at a first location in such a manner that the flexible hose portion is able to rotate about the longitudinal axis of the rigid wand portion, the end portion having an outlet which communicates with the interior of the wand, and wherein the end portion has a support on the outer wall thereof, the support being located upstream of the outlet, extending over a span between the end portion and the rigid wand portion at a second location and being capable of rotational movement about the longitudinal axis of the rigid wand portion.

2. The hose and wand assembly according to claim 1, wherein the flexible hose portion is able to rotate with respect to the rigid wand portion through a limited angular distance.

3. The hose and wand assembly according to claim 2, wherein the flexible hose portion is able to rotate with respect to the rigid wand portion through an angle of at least 60°.

4. The hose and wand assembly according to claim 3, wherein the flexible hose portion is able to rotate with respect to the rigid wand portion through an angle of substantially 90°.

5. The hose and wand assembly according to claim 1, 2, 3 or 4, wherein the end portion has a circular mouth which is received by a socket forming part of the rigid wand portion.

6. The hose and wand assembly according to claim 1, 2, 3 or 4, wherein the support on the outer wall of the end portion is aligned with the longitudinal axis of the rigid wand portion.

7. The hose and wand assembly according to claim 6, wherein the support is a supporting lug which has a bore for receiving a peg, the peg passing through an aperture in an internal wall in the wand portion and being received in the bore.

8. The hose and wand assembly according to claim 1, 2, 3 or 4, wherein the handgrip portion comprises a gripping portion which is located in the vicinity of the coupling between the flexible hose portion and the rigid wand portion.

9. The hose and wand assembly according to claim 8, wherein the gripping portion is located on the side of the coupling which is remote from the rigid wand portion.

10. The hose and wand assembly according to claim 8, wherein the gripping portion is located on the side of the longitudinal axis of the rigid pipe portion which is remote from the side from which the flexible hose portion extends.

11. The hose and wand assembly according to claim 1, 2, 3 or 4, wherein the flexible hose portion is also rotatable with respect to the rigid wand portion about a second axis which is not coincident with the longitudinal axis of the rigid wand portion.

12. The hose and wand assembly according to claim 11, wherein the second axis is the longitudinal axis of the flexible hose portion.

13. The hose and wand assembly according to claim 1, 2, 3 or 4, wherein the longitudinal axis of the rigid wand portion is inclined to the longitudinal axis of the flexible hose portion at an angle of no more than 120°.

14. The hose and wand assembly according to claim 13, wherein the angle between the longitudinal axis of the rigid wand portion and the longitudinal axis of the flexible hose portion is substantially 115°.

15. A vacuum cleaner comprising the hose and wand assembly according to claim 1, 2, 3 or 4.

* * * * *